US006324779B1

(12) United States Patent
Tippmann, Jr.

(10) Patent No.: US 6,324,779 B1
(45) Date of Patent: Dec. 4, 2001

(54) GUN HAVING A CURVED BARREL

(75) Inventor: Dennis J. Tippmann, Jr., Fort Wayne, IN (US)

(73) Assignee: Tippmann Pneumatics, Inc., Fort Wayne, IN (US)

( * ) Notice: Subject to any disclaimer, the term of this patent is extended or adjusted under 35 U.S.C. 154(b) by 0 days.

(21) Appl. No.: 09/333,083

(22) Filed: Jun. 14, 1999

(51) Int. Cl.[7] ..... F41A 21/00; F41B 11/00

(52) U.S. Cl. ..... 42/76.01; 42/75.02; 124/81; 124/83

(58) Field of Search ..... 42/76.01, 75.02; 124/81, 83

(56) References Cited

U.S. PATENT DOCUMENTS 1,187,218 6/1916 Wister .
1,348,987 * 8/1920 Fischer .
3,329,063 * 7/1967 Ehrenburg et al. ..... 42/76.01
3,610,222 10/1971 Hartman .
4,250,862 2/1981 Speer .
4,345,578 8/1982 Speer .
5,450,838 9/1995 Nakahigashi et al. .
5,640,945 6/1997 Slonaker et al. .
5,655,510 8/1997 Kunimoto .

OTHER PUBLICATIONS

Popular Science, p. 172, Mar. 1952.*

* cited by examiner

*Primary Examiner*—Michael J. Carone
*Assistant Examiner*—Kyongtaek K. Mun
(74) *Attorney, Agent, or Firm*—Barnes & Thornburg

(57) ABSTRACT

A gun having a slightly curved bore for discharging a frangible generally spherical projectile creating an improvement in trajectory of the projectile. The slightly curved bore applies a spin onto the spherical projectile without causing the projectile to rupture.

7 Claims, 5 Drawing Sheets

GUN HAVING A CURVED BARREL

TECHNICAL FIELD

The present invention relates generally to guns. More particularly, the present invention is directed to a gun having a slightly curved bore that applies a spin onto a frangible generally spherical projectile, without causing the projectile to rupture.

BACKGROUND ART

A variety of guns for firing frangible, generally spherical projectiles are known in the art. Marking guns, (commonly referred to as paint ball guns) for example, use pressure from compressed gas such as nitrogen or carbon dioxide to fire a gelatinous capsule containing a marking material (usually paint). The capsule breaks on impact with a target dispersing the material thereby marking the target. A popular recreational use for marking guns is in "survival games," a kind of mock war where opposing sides attempt to seek out and "shoot" one another with paint balls. Paint ball guns have also been used to segregate cattle within a herd and for a variety of other marking purposes.

Paint balls fired from such guns may have a limited trajectory because of the flight characteristics imposed on them by the amount of force that can be applied and by the configuration of the bore. In some applications, restrictions may exist on the velocity with which the ball may be expelled from the barrel. Consequently, there is a need for a gun that can affect the trajectory of the paint ball by changing its flight characteristics through changes in the gun bore rather than by increases in force applied to the ball.

It is important to note that paint balls are relatively frangible. It is, therefore, necessary that the structure or method used to improve the trajectory of the paint ball does not cause premature rupture of the ball.

SUMMARY OF THE INVENTION

The present invention relates to a gun that applies a spin to a generally frangible projectile to improve its trajectory without causing it to rupture. One embodiment of the invention includes a firing mechanism that fires the projectile through a bore. A barrel having a breech end is coupled to the firing mechanism for receiving the frangible projectile. The bore extends longitudinally between the breech end and a muzzle end in the barrel and is slightly curved so as to impart a spin to the frangible projectile as the projectile travels through the bore.

In another embodiment of the present invention, the gas powered gun has a breech end connected to the firing mechanism at an angle such that the muzzle end is perpendicular to the longitudinal axis of the firing mechanism. Alternatively, the breech end may be angled perpendicular or non-perpendicular to the longitudinal axis of the firing mechanism irrespective of the muzzle end. Corresponding threads on the breech end and firing mechanism cooperate to connect same.

In a further embodiment, the gas powered gun has a muzzle end that can be positioned either perpendicular or non-perpendicular to the longitudinal axis of the firing mechanism. The gun may also have a shroud to mask at least a portion of the slightly curved barrel.

BRIEF DESCRIPTION OF DRAWINGS

The present invention will be described hereafter with reference to the attached drawings which are given as non-limiting examples only, in which.

Corresponding reference characters indicate corresponding parts throughout the several FIGS. The exemplification set out herein illustrates preferred embodiments of the invention and such exemplification is not to be construed as limiting the scope of the invention in any manner.

DETAILED DESCRIPTION OF THE INVENTION

The present invention relates generally to guns. More particularly, the present invention is directed to a gun having a slightly curved bore that applies a spin onto a frangible generally spherical projectile, without causing the projectile to rupture. The gun of the present invention may use any conventional force to expel the projectile from the bore. The gun may be of any conventional size and shape. In addition, the gun may provide for any conventional firing mechanism as well as any generally spherical projectile.

The following description is but one embodiment of the curved bore air gun, and will be described with reference to FIGS. 1–5. While the described embodiments are considered by the inventor to be the best mode of carrying out the invention, it should be understood that the claims presented below are not limited to the particular details of the described embodiments. Numerous variations may be readily apparent to those of skill in the art which would provide for construction of the curved bore gas powered gun which incorporate the principles of the present invention as claimed.

Figure 1:
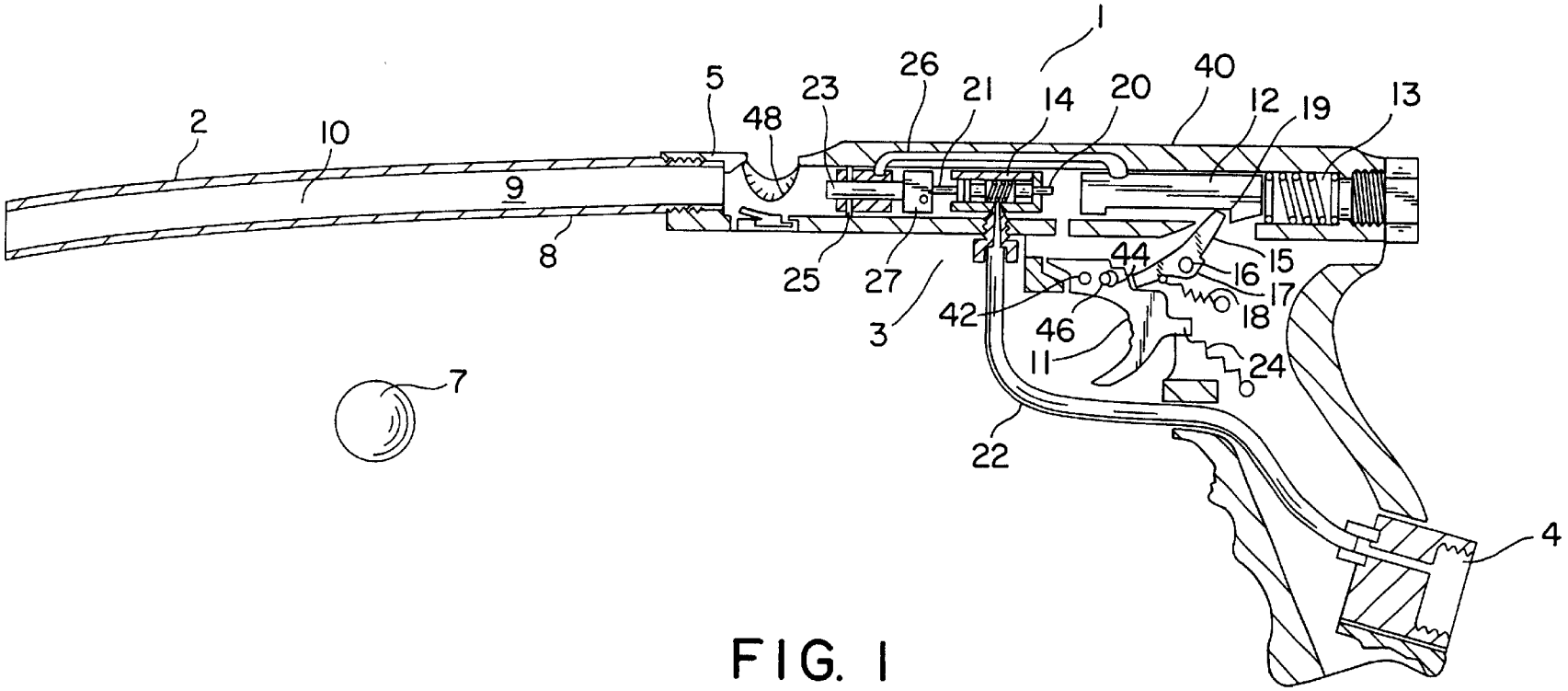
FIG. 1 is a cross-sectional, side-elevation view of a gas powered gun including one embodiment of the present invention.

Gun 1, shown in FIG. 1, comprises three major assemblies: a barrel 2, a firing mechanism 3, and a propellant source means (e.g. gas source inlet 4).

Barrel 2 comprises a breech end 5 and a muzzle end 6. Breech end 5 of barrel 2 attaches to firing mechanism 3. Muzzle end 6 of barrel 2 expels a frangible generally spherical projectile 7 when gun 1 is fired. (See also FIG. 2.) A bore 8 is formed along the longitudinal extent 9 of barrel 2. Bore 8 creates a slightly curved path 10 along the longitudinal extent 9 of barrel 2. In one illustrative embodiment bore 8 is curved through barrel 2 which is itself curved. Illustratively, a slightly curved path may be bored through a substantially straight barrel. In either case gun bore 8 should have a generally large radius of curvature of about 40 inches to about 60 inches. Illustratively the barrel may have about a 51½ inch radius. In addition, muzzle 6 is illustratively perpendicular to the radius of curvature of bore 8.

Figure 4:
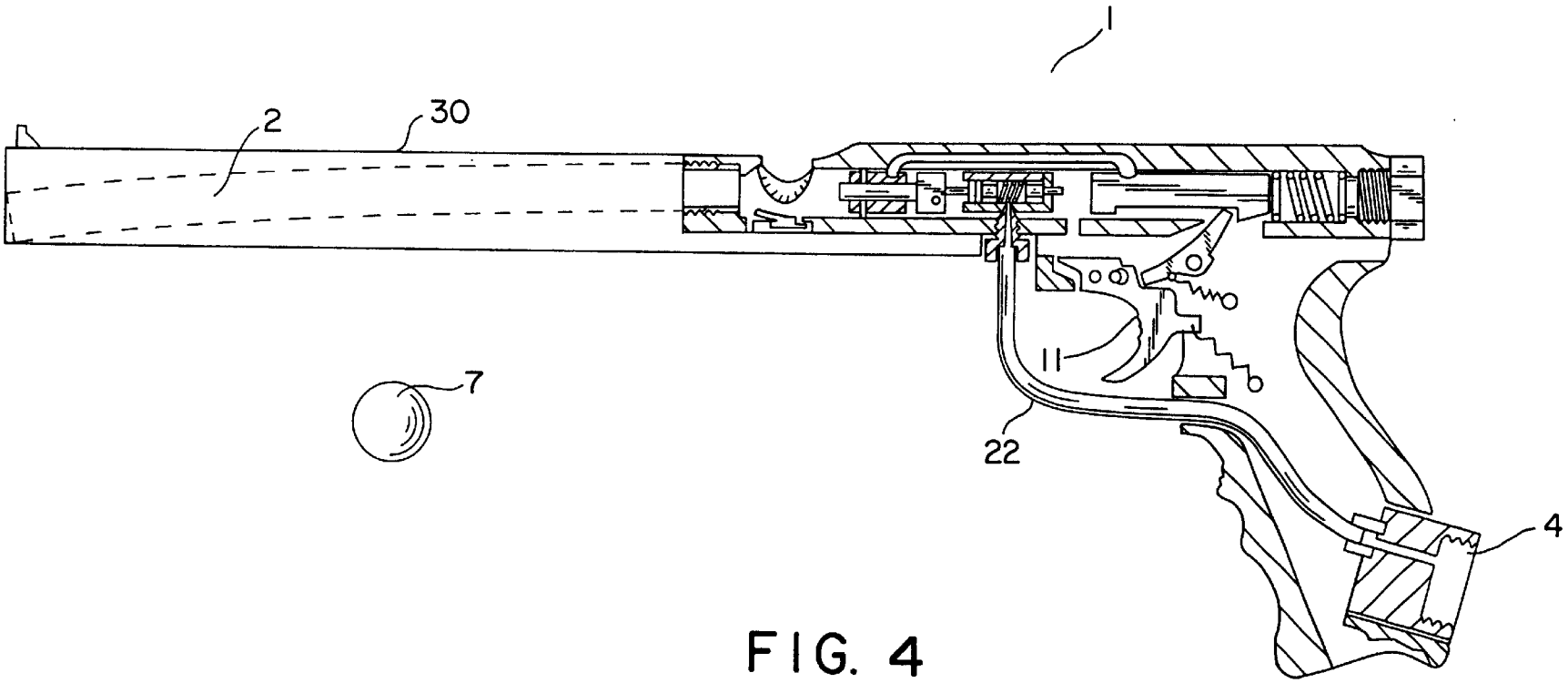
FIG. 4 is a cross-sectional side elevation view of another embodiment of a gas powered gun.

Barrel 2 is connectable to a body 40 illustratively by a series of threads, as best shown in FIG. 4. It is appreciated, however, that barrel 2 may be connected to body 40 by any variety of conventional ways. For example, the barrel may be lock-fit, friction fit or even be an integral part of body 40. In addition, breech end 5 might be angled to affect the direction projectile 7 travels once it leaves muzzle end 6. (See also FIG. 5.)

Body 40 is configured to house all the components of firing mechanism 3. Any conventional firing mechanism may be used to fire the projectile through bore 8. Illustratively, firing mechanism 3 comprises a trigger 11 which is user actuable, and a recoil slide 12 which is movable under the bias of a spring 13 upon actuation of trigger 11. Firing mechanism 3 also comprises a valve assembly 14 illustratively actuable by slide impact to selectively release a quantity of compressed gas thereby causing the force to expel frangible generally spherical projectile 7 through bore 8. It will be appreciated that valve assembly 14 may be replaced with any comparable assembly that selectively releases a quantity of gas to force the expulsion of generally spherical projectile 7 through bore 8.

Gas inlet 4 is designed to receive any variety of sources of gas. For example, inlet 4 may be configured to connect directly to a compressed gas tank or a canister. Or, inlet 4 may connect to a hose which also connects to a gas source. Either way, gas inlet 4 is interposed between the gas source (not shown) and valve assembly 14. Gas inlet 4 supplies gas to valve assembly 14, illustratively, by way of a hollow trigger guard tube 22 connectable to both.

Trigger 11 is attached to housing 40 by pivot pin 42 and has an allowable range of movement defined by elongated aperture 44 and pin 46. The illustrative range of movement extends to that of a typically pulled trigger. A pivotable lever 15 is interposed between trigger 11 and recoil slide 12. Lever 15 has a hole 16 disposed therethrough which is slightly elongated about its axis of rotation and which receives pivot pin 17. Lever 15 is biased by spring 18 in a counterclockwise direction about pin 17 so that lever 15 catches notch 19 in recoil slide 12 holding recoil slide 12 in its rearward or "cocked" position ready to fire. Discharge of gun 1 by is caused by actuation of trigger 4. When trigger 11 is pulled as shown by the hatched outline of trigger 11, elongated hole 16 allows lever 15 to migrate about pivot pin 17 and slip past the end of trigger 11 releasing slide 12.

Illustratively, recoil slide 12, projectile 7 (once it is placed in firing mechanism chamber 48), and valve assembly 14 are all axially aligned with the breech end 5 of barrel 2. Valve assembly 14 is positioned between projectile 7 and recoil slide 12 and is slightly movable along this common axis within predetermined limits. Valve assembly 14 receives the pressurized gas from hose 22. To release the gas, valve assembly 14 includes impact valves positioned at each axial end thereof. First impact valve 20 faces recoil slide 12, and second impact valve 21 faces breech end 5. After recoil slide 12 is released, spring 13 biases recoil slide 12 toward impact valve 20. Shuttle 25, axially fitted about funnel 23 and connected to recoil slide 12 via connecting rod 26, moves projectile 7 into bore 8 just past breech end 5. As recoil slide 12 impacts valve 20, valve 20 opens slightly causing a blow-back gas pressure forcing recoil slide 12 back against spring 13. The recoil slide lever 15 catches notch 19 in recoil slide 12 holding it in its "cocked" position.

Force from recoil slide 12 impacting valve 20 not only causes that valve to open, but it also causes the entire valve assembly 14 to move slightly forward toward breech end 5. This forward movement causes impact valve 21 to engage a transverse bar 27 inside funnel 23 thereby slightly opening valve 21 and allowing the gas under pressure to expel through funnel 23. The force from this pressure propels projectile 7 through bore 8. It is appreciated that curved bore 8 may attach to any type of firing mechanism. This firing mechanism described is for illustrative purposes only. It is appreciated that any mechanism for accelerating the projectile may be used. For example, such mechanisms include nitrogen under pressure, ignited propane, oxygen, and/or butane, and springs.

Figure 2:
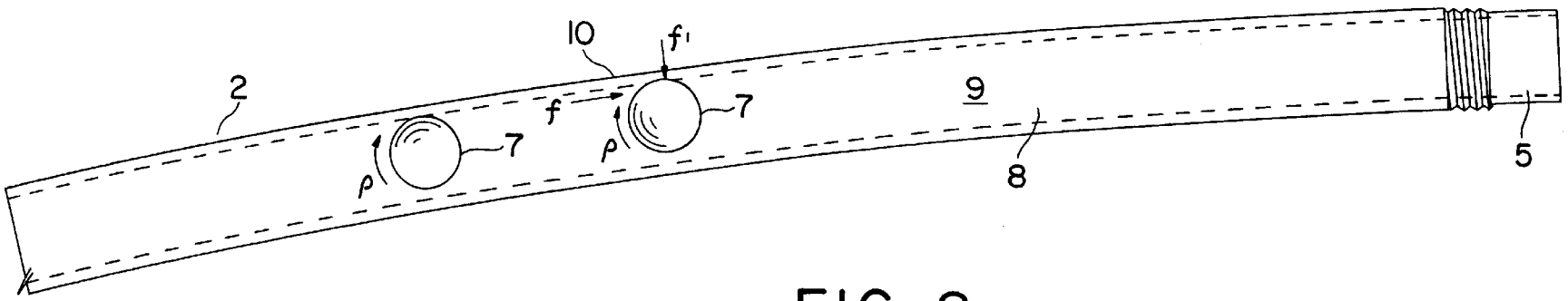
FIG. 2 is a cross-sectional side-elevation view of a portion of the gas powered gun from FIG. 1.

The manner in which projectile 7 travels through bore 8 is best illustrated in FIG. 2. As projectile 7 travels through bore 8, it contacts a slightly curved path 10. Centripetal force acting on projectile 7 causes it to contact upper surface 28 creating friction $f$ imparting a rotational velocity $\rho$ onto spherical projectile 7. This rotation $\rho$ continues as a back-spin. Once projectile 7 exits barrel 2, the back-spin motion counteracts the force of gravity creating substantially improved trajectory.

Frangible, generally spherical projectile 7 is typically a paint ball. Because these paint balls are designed to rupture on impact, they are usually relatively frangible. The slight curvature of the bore of the barrel is effective to back-spin to the projectile, while not rupturing it prematurely. If the radius of curvature barrel 2 is too small, friction $f$ or centripetal force $f'$ acting on the ball may rupture projectile 7. As previously stated, an illustratively preferable radius of curvature for bore 8 is about 40inches to about 60 inches.

Figure 3:
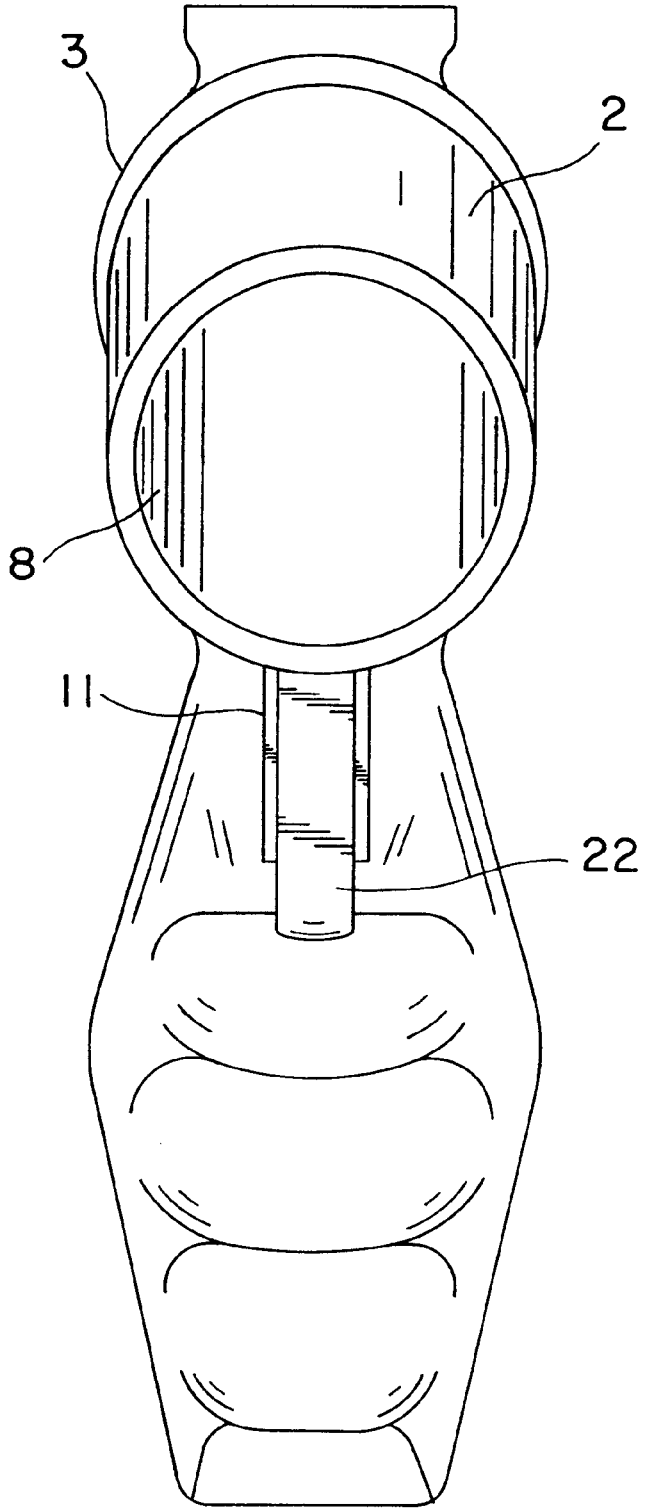
FIG. 3 is a front elevation view of a portion of the gas powered gun from FIG. 1.

The extent of the curvature of bore 8 may be well appreciated as shown in FIG. 3. It will be appreciated that in one illustrative embodiment, the inner diameter of bore 8 remains substantially constant along its longitudinal extent 9. (See also FIG. 2.) The internal diameter of bore 8 is determined by the size of the paint ball or other projectile used. In one illustrative embodiment, the diameter of bore 8 may be sightly larger than the diameter of projectile 7. This is so that as projectile 7 propels through bore 8 and contacts upper surface 28, projectile 7 has sufficient clearance to rotate through bore 8 without interference by any other part of the bore. In addition, sufficient clearance illustratively includes taking into account any deformation that might occur to projectile 7 as it travels through bore 8.

Because a curved barrel may cause disorientation to an operator who is used to aiming a gun along a straight barrel, a shroud 30 may be fitted over barrel 2, as shown in FIG. 4. The operator, therefore, may now be able to aim along shroud 30 of gun 1 just as he/she would a straight barrel. The shroud 30 may be made from any myriad of materials including aluminum, steel, plastic or some type of fiberglass, for example. The shroud can also be configured in any myriad of ways so as to give the user of the gun the impression of a gun having a straight barrel.

Figure 5:
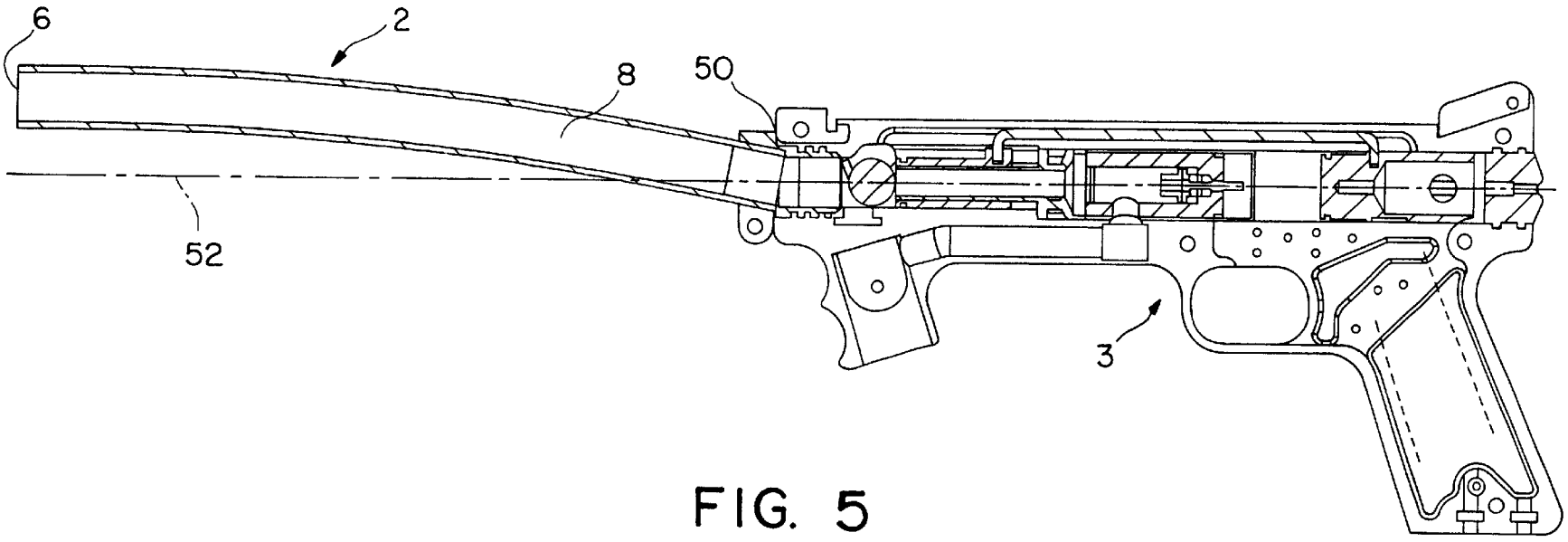
FIG. 5 is a cross-sectional side-elevation view of a further embodiment of a gas powered gun.

In another illustrative embodiment, barrel 2 having curved bore 8 may be positioned at an angle relative to the firing mechanism such that muzzle end 6 is substantially perpendicular to longitudinal axis 52 of firing mechanism 3. Projectile 7 will exit muzzle 6 traveling along a path parallel to line 52. This is advantageous from the standpoint that projectile 7, as it is projected from muzzle 6, will travel in generally the same direction as gun 1 is pointing. Because of the aerodynamic effects spin creates, the projectile may have an improved trajectory when the gun is fired in a typical, upright orientation. When the gun is oriented in an alternative position, (e.g., sideways) the spin causes the projectile to a laterally curved trajectory. Illustratively, the angle of muzzle 6 may be changed by changing the angle of breech end 5. An angled breech end 50, as shown in FIG. 5, affects the angle of muzzle end 6. (Compare to FIG. 1.) As a result, the changed angle of muzzle end 6 changes the angle with which article 7 exits bore 8. Furthermore, breech end 2 might be rotatably attached to firing mechanism 3 such that bore 8 may be selectively angled with respect to firing mechanism 3 along one or more axis to change the direction the ball shoots.

Traditional aiming means like sights and scopes may be attached to the gun embodying the present invention, just as they would other guns. For this present embodiment, the illustrative line of sight is preferably raised such that the line of sight be above muzzle end 6. In addition, it may be preferable to ensure the line of sight be perpendicular with muzzle end 6. This will ensure that projectile 7 will travel in the same general direction as the sight is aiming.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as set forth in the following claims.

What is claimed is:

1. A gun for firing a frangible projectile comprising:

a firing mechanism having a longitudinal axis; and a barrel having a breech end coupled to the firing mechanism for receiving the frangible projectile, a muzzle end face, and a bore extending longitudinally between said breech end and muzzle end face, wherein said bore is curved so as to impart a spin to the frangible projectile as the projectile travels through the bore, and the breech end of the bore is connected to the firing mechanism at an angle such that the muzzle end face is substantially perpendicular to the longitudinal axis of the firing mechanism.

2. The gun of claim 1, wherein the breech end comprises a breech end face that is connected to the firing mechanism at an angle generally perpendicular to the longitudinal axis of the firing mechanism.

3. The gun of claim 1, further comprising corresponding threads that connect the breech end to the firing mechanism.

4. The gun of claim 1, wherein the muzzle end is perpendicular to the longitudinal axis of the firing mechanism.

5. The gun of claim 1, further comprising a shroud to mask at least a portion of the curved barrel.

6. The gun of claim 1, wherein a radius of curvature of the bore ranges from 40 to 60 inches.

7. The gun of claim 6, wherein the radius of curvature of the bore is about 51½ inches.

* * * * *